US011982272B2

(12) United States Patent
Lazzerini et al.

(10) Patent No.: US 11,982,272 B2
(45) Date of Patent: May 14, 2024

(54) VARIABLE DISPLACEMENT LUBRICANT PUMP HAVING A RADIAL INLET OR OUTLET OPENING AXIALLY BETWEEN AT LEAST TWO BUSHING RINGS

(71) Applicant: PIERBURG PUMP TECHNOLOGY GMBH, Neuss (DE)

(72) Inventors: Massimiliano Lazzerini, Cecina (IT); Carmine Cuneo, Pisa (IT); Alessandro Malvasi, Leghorn (IT)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 121 days.

(21) Appl. No.: 17/613,092

(22) PCT Filed: May 23, 2019

(86) PCT No.: PCT/EP2019/063281

§ 371 (c)(1),
(2) Date: Nov. 22, 2021

(87) PCT Pub. No.: WO2020/233813

PCT Pub. Date: Nov. 26, 2020

(65) Prior Publication Data

US 2022/0307497 A1 Sep. 29, 2022

(51) Int. Cl.
*F04C 2/344* (2006.01)
*F04C 14/22* (2006.01)

(52) U.S. Cl.
CPC ..... *F04C 2/3442* (2013.01); *F04C 14/22* (2013.01); *F04C 14/226* (2013.01);
(Continued)

(58) Field of Classification Search
CPC .... F04C 2/3442; F04C 2/348; F04C 18/3442; F04C 18/348; F01C 1/3442; F01C 1/348
See application file for complete search history.

(56) References Cited

U.S. PATENT DOCUMENTS 2,684,037 A * 7/1954 Scognamillo ..... F04C 2/3442 418/256
5,484,271 A 1/1996 Stich
(Continued)

FOREIGN PATENT DOCUMENTS

CN 102906426 A 1/2013
CN 103711692 A 4/2014
(Continued)

OTHER PUBLICATIONS

Machine Translation of Lidlgruber (DE 3109835), 1982 (Year: 1982).*

*Primary Examiner* — Laert Dounis
(74) *Attorney, Agent, or Firm* — Norman B. Thot

(57) ABSTRACT

A variable displacement lubricant pump for providing a pressurized lubricant for a motor vehicle. The pump includes a pump rotor which rotates about a rotor axis and a control ring which is shiftable. The pump rotor includes a pump rotor shaft, a rotor body having vane slits, and pump vanes which are arranged in and which axially slide in the vane slits. The control ring can be actuated to set an eccentricity of the control ring to define a volumetric pump performance. The control ring defines a pump chamber which is separated by the pump vanes into pumping compartments. The control ring includes a control ring main body, bushing rings which are arranged separately at a radial inside of the control ring main body, and a radial inlet opening and/or a radial outlet opening. The radial inlet opening and/or the radial outlet opening is/are arranged axially between the bushing rings.

10 Claims, 2 Drawing Sheets

(52) U.S. Cl.
CPC .... *F04C 2210/14* (2013.01); *F04C 2210/206* (2013.01); *F04C 2240/20* (2013.01); *F04C 2240/30* (2013.01); *F04C 2270/18* (2013.01)

(56) References Cited

U.S. PATENT DOCUMENTS

| | | | |
|---|---|---|---|
| 2013/0071275 | A1 | 3/2013 | Gasperini et al. |
| 2015/0240806 | A1 | 8/2015 | Merk |

FOREIGN PATENT DOCUMENTS

| | | | | |
|---|---|---|---|---|
| CN | 104879299 | A | | 9/2015 |
| DE | 3109835 | A1 | * | 9/1982 |
| DE | 34 46 603 | A1 | | 7/1985 |
| DE | 40 11 671 | A1 | | 10/1991 |
| EP | 2 351 934 | A1 | | 8/2011 |
| EP | 2 735 740 | A1 | | 5/2014 |
| WO | WO 93/14318 | A1 | | 7/1993 |
| WO | WO 2014/083063 | A1 | | 6/2014 |

* cited by examiner

VARIABLE DISPLACEMENT LUBRICANT PUMP HAVING A RADIAL INLET OR OUTLET OPENING AXIALLY BETWEEN AT LEAST TWO BUSHING RINGS

CROSS REFERENCE TO PRIOR APPLICATIONS

This application is a U.S. National Phase application under 35 U.S.C. § 371 of International Application No. PCT/EP2019/063281, filed on May 23, 2019. The International Application was published in English on Nov. 26, 2020 as WO 2020/233813 A1 under PCT Article 21(2).

FIELD

The present invention is directed to a variable displacement lubricant pump for providing a pressurized lubricant for a motor vehicle, in particular for the internal combustion engine.

BACKGROUND

A lubricant pump is typically provided to circulate a lubricant in a lubricant circuit, primarily for lubricating mechanical parts of the motor vehicle such as parts of an internal combustion engine or a transmission. The lubricant pump must have a reliable design in order to prevent damage to the lubricant pump caused, for example, by cavitation, as well as to parts of the transmission or the internal combustion engine, if the pump malfunctions or even completely breaks.

A typical variable displacement pump is described in WO 2014/083063 A1. The pump rotor is provided within a pump housing, is co-rotatably fixed to a rotor shaft, and comprises vane slits. The vanes are arranged in the vane slits, are moveable radially inwardly and outwardly in the vane slits, and are in contact with an inner surface of the control ring. The rotation of the pump rotor and the vanes causes the pumping of a fluid from a suction port to a discharge port through a pump chamber which is defined by the inner surface of the control ring, the pump rotor, and the vanes. The plastic control ring of the displacement pump is provided with a radial inlet opening and a radial outlet opening.

The radial inlet and outlet openings of the pump provide a high volumetric pump performance and a low flow resistance. Due to the radial openings in the control ring, however, the rotating pump vanes that are always in contact with the control ring cause temporarily high mechanical surface pressures because of the smaller contact area in the control ring segments in which the radial openings are arranged. This can cause increased local wear in the control ring segments being provided with the radial openings. Irregular wear at the control ring can result in internal leakage and therefore in a loss of volumetric pump efficiency.

SUMMARY

An aspect of the present invention is to provide a pump design that reduces wear, provides sufficient volumetric flow rates, and reduces the risk of cavitation.

In an embodiment, the present invention provides a variable displacement lubricant pump for providing a pressurized lubricant for a motor vehicle. The variable displacement lubricant pump includes a pump rotor which is configured to rotate about a rotor axis and a shiftable control ring. The pump rotor comprises a pump rotor shaft, a rotor body which comprises vane slits, and pump vanes which are arranged in and which are configured to be axially slidable in the vane slits. The shiftable control ring is configured to be actuated so as to set an eccentricity of the shiftable control ring so as to define a volumetric pump performance. The shiftable control ring defines a pump chamber which is separated by the pump vanes into pumping compartments. The shiftable control ring comprises a control ring main body, at least two bushing rings which are arranged separately at a radial inside of the control ring main body, and at least one of a radial inlet opening and a radial outlet opening. The at least one of the radial inlet opening and the radial outlet opening is/are arranged axially between the at least two bushing rings.

BRIEF DESCRIPTION OF THE DRAWINGS

The present invention is described in greater detail below on the basis of embodiments and of the drawings in which.

DETAILED DESCRIPTION

Figure 1:
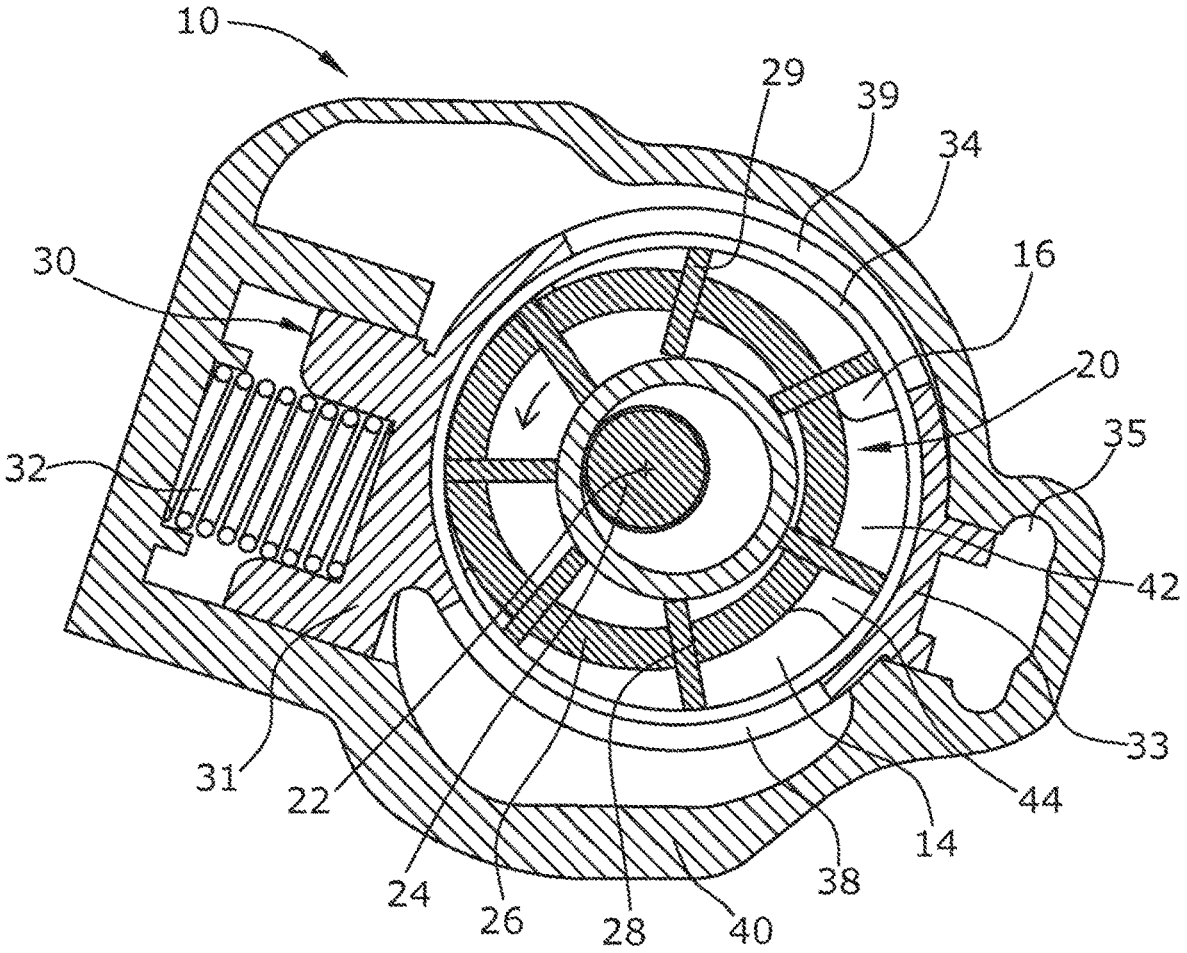
FIG. 1 shows a cross section of a variable displacement lubricant pump including a control ring.

The variable displacement lubricant pump according to the present invention is provided with a pump rotor that rotates about a rotor axis. The pump rotor comprises a pump rotor shaft that is driven mechanically by the internal combustion engine of the motor vehicle. The pump rotor shaft is directly mechanically connected to the internal combustion engine, for example, via a belt pulley and a belt; the rotational speed of the pump rotor shaft therefore correlates with the rotational speed of the internal combustion engine.

The pump rotor also comprises a rotor body that is fixed to the rotor shaft and therefore co-rotates with the rotor shaft. The rotor body is arranged concentrically to the rotor shaft, the rotor shaft being located radially inside the rotor body. The rotor body has radial recesses that serve as vane slits. The pump rotor comprises pump vanes that are provided radially slidable in the vane slits. The distal ends of the pump vanes are always in contact with the inner surface of a control ring. The contact pressure between the distal ends of the pump vanes and the inner surface of the control ring at a low rotation speed can be provided and maintained, for example, by arranging preloaded springs at proximal ends of the pump vanes. The proximal ends of the pump vanes can be supported directly or indirectly by a shiftable support ring. While rotating, this arrangement ensures the transport of a lubricant from a low pressure side to a high pressure side.

The control ring of the variable displacement lubricant pump is arranged to be shiftable. The linear or pivotable movement of the control ring is guided and limited by pump housing protrusions and pump housing segments. One or more helical preload springs push the control ring into a position of higher eccentricity. The concrete shifting position of the control ring defines the volumetric pump performance of the variable displacement pump.

The entirety of all pumping compartments define a pump chamber that is defined by the space between the control ring and the rotor body.

The control ring is provided with a radial inlet opening and/or a radial outlet opening. The radial openings can serve as additional openings to axial openings. The additional radial openings increase the total inlet and outlet area, thereby reducing flow resistance and cavitation risk. Cavitation effects, such as pump noise and pressure peaks due to the implosion of potential gas bubbles in the lubricant, are thereby reduced.

The control ring can, for example, be produced via a co-molding process. The control ring is provided with a control ring main body and with at least two separate parallel bushing rings that are arranged at the radial inside of the control ring main body. The bushing rings are axially spaced from each other and define the contact surface for the vanes that co-rotate with the pump rotor. The bushing rings are abrasion-resistant and therefore reduce wear of the control ring. This results in an extended longevity of the control ring and of the variable displacement lubricant pump.

The radial inlet opening and the radial outlet opening are arranged axially between the two bushing rings. The bushing rings can be provided with a relatively small axial width, thereby allowing the radial openings to be relatively large in the axial direction, thereby increasing the potential volumetric pump performance at high rotational speed.

The bushing rings can, for example, be metallic in order to provide sufficient wear resistance with respect to the rotating pump vanes which are continuously in frictional contact with the bushing rings of the control ring. Alternative materials for the bushing rings are ceramics so that the bushing rings can be produced via a sintering process. Metals are, however, easier to manufacture and are less brittle. The bushing rings can be provided and supported to be rotatable in relation to the control ring main body. The bushing rings are alternatively totally fixed non-rotatably to the control ring main body.

In an embodiment of the present invention, the control ring main body material can, for example, be a plastic. Advantages of plastics include low weight and easy and cost-efficient manufacturing.

The radial inlet opening and the radial outlet opening can, for example, be arranged to be substantially diametrically opposite to each other. This enables a substantially symmetric design of the control ring and easy manufacturing.

In an embodiment of the present invention, the pump housing material can, for example, be a metal. In contrast to plastics, metals have a higher mechanical stiffness and robustness so that clearances within the pump remain unchanged at different temperatures. Compared with plastics and ceramics, metals also have higher heat transfer coefficients which helps to cool down the lubricant.

In an embodiment of the present invention, the pump housing material can, for example, be made of aluminum. Aluminum has one of the highest thermal conductivities among metals and is therefore suitable as a pump housing material. Aluminum is also a lightweight metal due to its low density.

The pump vanes can, for example, be made of plastic. Plastic materials have low densities and are easy to manufacture. The low densities also result in low centrifugal forces which is particularly important at high rotational speeds of the pump. Wear on the control ring or the bushing rings correlate with normal forces on the control ring or the bushing rings. The lighter the pump vanes are, the smaller the normal forces exerted by the pump vanes.

In an embodiment of the present invention, the rotor body can, for example, also be made of plastic, for example, of the same plastic as the control ring main body. A plastic rotor body that is connected to the rotor shaft reduces the weight of the pump rotor and therefore also reduces the mass inertia and finally the power consumption of the pump. Using the same material for the rotor body and the control ring main body provides geometrical consistency in that the thermal extension of both pump parts in the axial direction are substantially identical, thereby avoiding an increase of clearances due to a temperature increase in operation.

Further advantages of the variable displacement pump will become evident by the following detailed description of embodiments of the present invention in combination with the enclosed drawings.

FIG. 1 shows a variable displacement lubricant pump 10 which is directly driven by an internal combustion engine so that the rotational speed of the pump 10 is always proportional to the rotational speed of the internal combustion engine.

The pump 10 comprises a pump housing 40 which is made of aluminum. As can be seen in FIG. 1, a pump rotor 20 is arranged inside the pump housing 40. The pump rotor 20 rotates about a static rotor axis 22 and consists of a metal rotor shaft 24 and a ring-like plastic rotor body 26 holding numerous plastic pump vanes 29. The rotor body 26 is provided with numerous radial vane slits 28 in which the pump vanes 29 are provided so as to be radially shiftable with respect to the rotor body 26.

The pump rotor 20 including the pump vanes 29 is radially surrounded by a shiftable control ring 30. The control ring 30 is not rotatable, but is radially and linearly shiftable with respect to the pump housing 40. A helical preload spring 32 pushes the control ring 30 into a position of higher eccentricity with respect to the rotor shaft 24. Two parallel helical preload springs 32 can alternatively be used.

The control ring 30 is provided with two identical metallic bushing rings 34 that are co-molded with the plastic control ring main body 31.

Inside the pump cavity, the rotor body 26, the pump vanes 29, and the control ring 30 define numerous rotating pumping compartments 44 which rotate in a counter-clockwise direction in FIG. 1. The pumping compartments 44 together define a pump chamber 42 of the pump 10.

Two sidewalls of the pump, which sidewalls are arranged opposite to each other, are, respectively, provided with a sickle-shaped axial inlet opening 14 and with a sickle-shaped axial outlet opening 16 through which the lubricant flows into the rotating pumping compartments 44 and flows out of the rotating pumping compartments 44, respectively.

FIG. 1 shows the maximum volume pumping constitution of the pump 10. This constitution is set by setting the maximum possible eccentricity of the control ring 30 with respect to pump rotor 20 or rotor shaft 24. In this position, the maximum flow rate of lubricant and the maximum pump outlet pressure is realized. Limitation and control of the flow rate and the pressure at the discharge port is controlled via a control chamber 35 which is hydraulically connected to the discharge port of the pump 10. The fluid pressure in the control chamber 35 pushes the control ring 30 via a control ring plunger 33 against the force of the counter-acting helical preload spring 32 into a lower volume pumping position of the pump 10. The maximum desired pressure as well as the flow rate at the outlet of the pump can therefore be set, among others, via the stiffness of the helical preload spring 32 and the pressure-active area in the control chamber 35.

Figure 2:
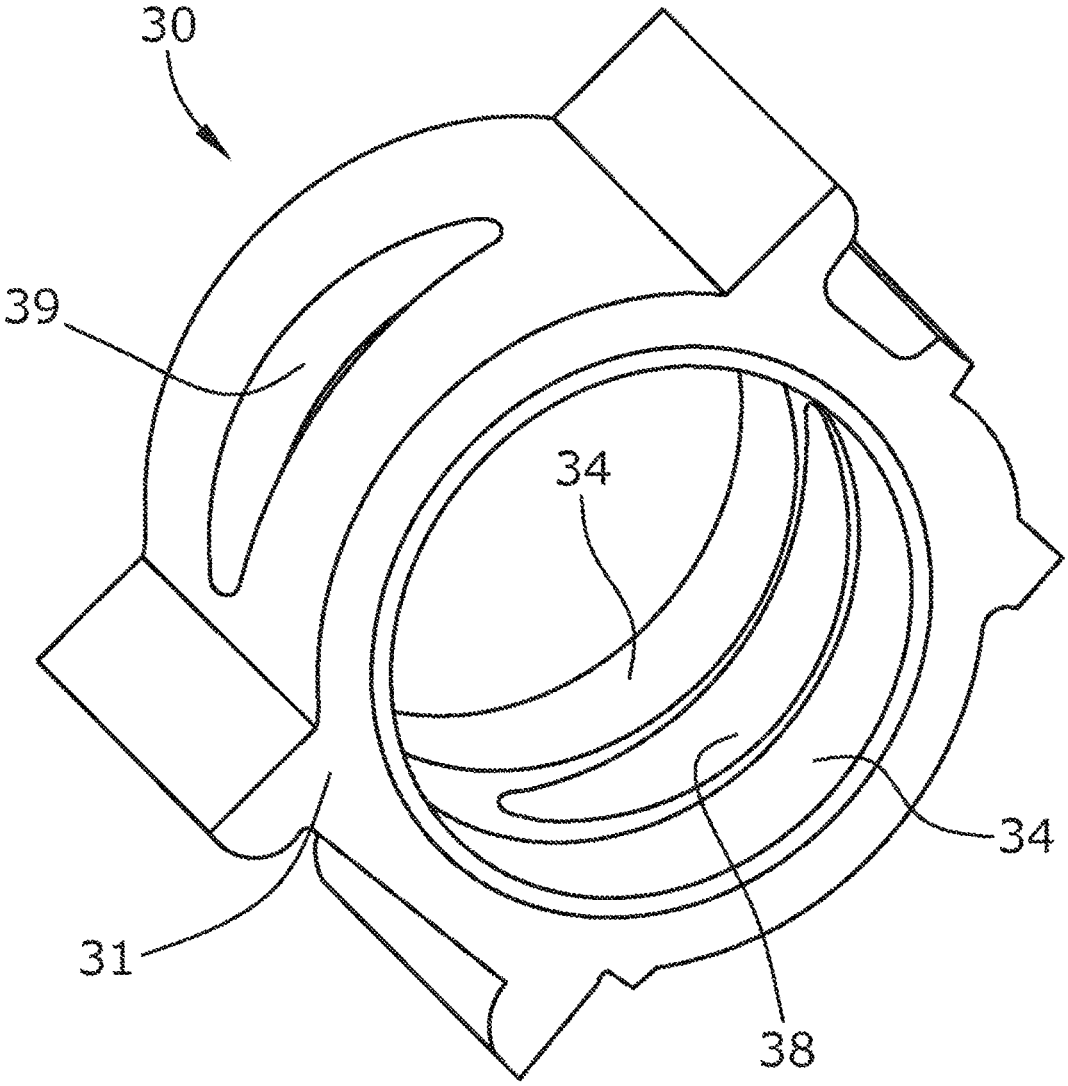
FIG. 2 shows a perspective view of the control ring of FIG. 1.

In order to improve the properties of the pump 10 against cavitation and enhance its capability to increase the volumetric pumping performance, the control ring 30 is provided with a window-like/slit-like radial inlet opening 38 and a window-like/slit-like radial outlet opening 39, as can be seen in FIGS. 1 and 2. The radial inlet opening 38 and the radial outlet opening 39 are provided in addition to the axial inlet opening 14 and axial outlet opening 16 of the pump 10 and allow higher local flow rates. It is also conceivable, however, that the radial openings are the only inlet and outlet openings for accessing the pumping compartments 44.

The slit-like radial inlet opening 38 and the slit-like radial outlet opening 39 are arranged diametrically opposite to each other. The axial extensions of the radial inlet opening 38 and of the radial outlet opening 39 can be maximized by maximizing the axial extension of the bushing rings 34. By setting large axial opening dimensions, the radial inlet opening 38 and the radial outlet opening 39 provide a large total inlet and outlet area, respectively, so that a low flow resistance through the openings is provided even at very high rotational speed of the pump rotor 20. A low flow resistance allows high flow rates. A low flow resistance also results in low pressure losses in the lubricant which reduces the risk of the gas formation in the lubricant. A low flow resistance therefore also reduces the risk of cavitation-caused problems such as material abrasion and noise.

The maximum size opening angles of the radial inlet opening 38 and the radial outlet opening 39 depend on the number of pump vanes 29 which corresponds to the angle of the pumping compartments 44 defined by two adjacent pump vanes 29.

The present invention is not limited to embodiments described herein; reference should be had to the appended claims.

LIST OF REFERENCE NUMERALS

10 Variable displacement lubricant pump
14 Axial inlet opening
16 Axial outlet opening
20 Pump rotor
22 Rotor axis
24 Rotor shaft
26 Rotor body
28 Vane slits
29 Pump vanes
30 Control ring
31 Control ring main body
32 Helical preload spring
33 Control ring plunger
34 Bushing rings
35 Control chamber
38 Radial inlet opening
39 Radial outlet opening
40 Pump housing
42 Pump chamber
44 Pumping compartments

What is claimed is:

1. A variable displacement lubricant pump for providing a pressurized lubricant for a motor vehicle, the variable displacement lubricant pump comprising:

a pump rotor which is configured to rotate about a rotor axis, the pump rotor comprising, a pump rotor shaft, a rotor body which comprises vane slits, and pump vanes which are arranged in and which are configured to be axially slidable in the vane slits; and a shiftable control ring which is configured to be actuated so as to set an eccentricity of the shiftable control ring so as to define a volumetric pump performance, the shiftable control ring defining a pump chamber which is separated by the pump vanes into pumping compartments, the shiftable control ring comprising, a control ring main body, at least two bushing rings which are arranged separately at a radial inside of and fixed non-rotatably to the control ring main body, and at least one of a radial inlet opening and a radial outlet opening, wherein, the at least one of the radial inlet opening and the radial outlet opening is/are arranged axially between the at least two bushing rings, and the pump vanes only contact the at least two bushing rings radially.

2. The variable displacement lubricant pump as recited in claim 1, wherein each of the at least two bushing rings are metallic.

3. The variable displacement lubricant pump as recited in claim 1, wherein the control ring main body comprises a material which is a plastic material.

4. The variable displacement lubricant pump as recited in claim 3, wherein the pump vanes are made of a plastic.

5. The variable displacement lubricant pump as recited in claim 4, wherein the plastic of the pump vanes and the plastic material of the control ring main body is the same.

6. The variable displacement lubricant pump as recited in claim 3, wherein the rotor body is made of a plastic.

7. The variable displacement lubricant pump as recited in claim 6, wherein the plastic of the rotor body and the plastic material of the control ring main body is the same.

8. The variable displacement lubricant pump as recited in claim 1, wherein, the shiftable control ring comprises both the radial inlet opening and the radial outlet opening, and the radial inlet opening and the radial outlet opening are arranged diametrically opposite to each other.

9. The variable displacement lubricant pump as recited in claim 1, further comprising a pump housing which comprises a material which is metallic.

10. The variable displacement lubricant pump as recited in claim 9, wherein the material of the pump housing which is metallic is aluminum.

* * * * *